United States Patent [19]

Wall

[11] Patent Number: 4,944,052

[45] Date of Patent: Jul. 31, 1990

[54] PUBLIC SANITARY CUBICLE

[76] Inventor: Hans Wall, St. Barbara Strasse 52, D-7517 Waldbronn, Fed. Rep. of Germany

[21] Appl. No.: 386,127

[22] Filed: Jul. 28, 1989

[30] Foreign Application Priority Data

Aug. 6, 1988 [DE] Fed. Rep. of Germany ..... 3826847

[51] Int. Cl.[5] ..... E03D 9/00; A47K 17/00

[52] U.S. Cl. ..... 4/662; 4/312; 4/661

[58] Field of Search ..... 4/622, 420, 661, DIG. 2, 4/233, 312

[56] References Cited

U.S. PATENT DOCUMENTS

| | | | |
|---|---|---|---|
| 3,381,312 | 5/1968 | Whitla | 4/233 |
| 3,713,176 | 1/1973 | Stock | 4/662 |
| 3,742,520 | 7/1973 | Barnardi | 4/662 |
| 3,747,129 | 7/1973 | Dyar | 4/662 |
| 3,969,133 | 7/1976 | McTighe et al. | 4/662 X |
| 4,301,558 | 11/1981 | Decaux | 4/662 X |
| 4,345,343 | 8/1982 | Shipman | 4/662 |

*Primary Examiner*—Henry K. Artis

*Attorney, Agent, or Firm*—Antonelli, Terry, Stout & Kraus

[57] ABSTRACT

A public sanitary cubicle comprises a sanitary room with a lavatory pan accessible via a door and a technical room separated therefrom by a partition and containing the means necessary for the supply, disposal and cleaning of the sanitary room and, in particular, a cleaning implement for the lavatory pan which can be brought into the sanitary room by a support arm for the cleaning, phase, as well as a drain. For rapid and effective cleaning the support arm carries a plurality of spray nozzles connected to a high pressure water source, whereof at least two are directed from above in different angular positions onto the lavatory pan and two or more are directed onto the sanitary room floor inclined towards the drain.

33 Claims, 3 Drawing Sheets

PUBLIC SANITARY CUBICLE

BACKGROUND OF THE INVENTION

The invention relates to a public sanitary room with a water closet accessible through a door and a technical room subdivided off therefrom by a partition and which is provided with the means necessary for the supply, disposal and cleaning of the sanitary room and, in particular, a cleaning implement which can be brought up to the water closet after moving the partition or part thereof, as well as a drain.

Sanitary cubicles of the aforementioned type have of late been installed to an increasing extent at busy points in large cities. They are constructed as a type of three-dimensional cell and; generally, comprise a reinforced concrete body with a trough-like base and a roof mounted thereon. The three-dimensional cell is internally subdivided into two rooms, namely the sanitary room and the technical room and, in general, the sanitary room is provided with its own inner wall structure, e.g. of high-grade steel, aluminum or plastic in order to satisfy hygienic requirements. The sanitary room is provided with a water closet or lavatory pan, a wash basin, optionally also a mirror, depositing points, racks or the like and with a door, generally a sliding door, which closes a cutout in the three-dimensional cell. The technical room contains all the functional parts for supply, disposal and cleaning purposes and has a separate access door for maintenance and repair purposes.

Access to sanitary cubicles of this type is obtained by inserting a coin, which unlocks the outer door and possibly sets into operation certain functional parts such as the flushing system, exhaust ventilation, etc. When the user leaves the sanitary room the door is closed again and also locked and automatically a clean process is put into operation, which, in particular, involves a complete cleaning of the lavatory pan, the floor and possibly the water basin. The cleaning cycle also includes a drying process, so that the following user is provided with a clean, dry sanitary room. At the end of the cleaning process the locking action is automatically released, so that the closure or lock on the outer door can again be opened by inserting a coin. Sanitary cubicles of this type are directly connected to the main sewage system in situ, so that they can be normally operated in maintenance-free manner as an autonomous sanitary unit The main problem in connection with such sanitary cubicles is a completely satisfactory cleaning of the sanitary room, particularly the complete lavatory pan and floor. It is not only necessary to remove faeces and paper from the lavatory pan in a complete manner, but also dirt, object left behind or thrown away, such as paper handkerchieves, packings, etc. Such a public sanitary cubicle will only be accepted by the public if it is hygienically cleaned in all respects. Various systems are known for cleaning purposes and, for example, in DE-A1 No. 33 22 356, the sanitary room and technical room are positioned concentrically to one another, the complete functional parts being located between the outer shell and the inner shell bounding the sanitary room. For cleaning purposes water passages are led out of the outer shell into the sanitary room, the water being distributed into the water closet, the washbasin and over the lower region of the inner wall. The water exclusively trickles over the walls and the pan. It is obvious that this type of water guidance does not permit intense cleaning, particularly an elimination of firmly adhering dirt or objects. In addition, the known construction of the toilet pan with siphon does not meet the requirements due to the considerable risk of clogging In another known construction, instead of mere water cleaning or in addition thereto, a mechanical cleaning is performed. Thus, in DE-C2 No. 30 22 788 several sanitary rooms are arranged around a technical center having a type of robot accommodated therein. The individual sanitary rooms are constructed as rotary cabins and are rotated in front of the technical room with their passage opening for the cleaning phase, so that the robot cleaning arm can be introduced into the cabin. In this position, the rear open water closet is directly connected to the drain in the technical room. The robot can be equipped with various cleaning tools such as, for example, brushes, scrapers, water nozzles, etc., and, in successive working cycles, initially coarse dirt and fragments are discharged from the water closet and the latter is subsequently cleaned. With this robot construction it is also possible to externally clean the water closet, optionally also the floor and walls of the cabin. However, this cleaning process is extremely time consuming, because it is constituted by several successively performed cleaning cycles. The cleaning robot is itself constructionally complicated and is also susceptible to operating faults due to the large number of functions.

In, for example, EP-A1 No. 0 109 469, during the cleaning phase the complete lavatory pan is pivoted rearwards into the technical room, so that coarse parts drop out by gravity or can be removed with a revolving brush during the subsequent cleaning process. However, there is no adequate cleaning of the outside of the pan and, in particular, not of the sanitary room. A similar construction in EP-A1 No. 0 059 134 provides for a revolving brush housed in the technical room, which can be inserted into the sanitary room after removing part of the partition between the sanitary room and the technical room and can be so controlled from the movement standpoint by of two telescopic arms perpendicular to one another that it externally, top and internally passes over at least the front of the water closet. Here again, dirty water and coarse parts pass into the drain in the technical room through the back of the water closet being largely open to the drain. The edges are cleaned by a water duct located in the sanitary room and the floor is connected by of a drain pipe to the drain. In a similar construction, not previously published DE-A1 No. 37 04 375, the revolving brush is mounted in the technical room so as to move from top to bottom on the water closet or is pivotably mounted on an arm and in the case of completely or partly open partition can be pivoted into the sanitary room or water closet. In the case of the two latter constructions the cleaning of the complete outer wall of the water closet, as well as the floor and possibly the lower region of the side walls is inadequate or impossible.

On the basis of the aforementioned and last evaluated prior art, the aim underlying the present invention is to provide a sanitary cubicle, in which there is an effective and complete cleaning of the entire water closet or lavatory pan and all other dirt-prone regions of the sanitary room, while involving minimum technical effort and expenditure.

According to the invention this problem is solved in that on the support arm is provided a plurality of spray nozzles connected to a high pressure water source, whereof at least two are directed from above in different angular positions onto the lavatory pan and two or more are directed onto the sanitary room floor inclined towards the drain.

In the case of the construction according to the invention cleaning exclusively takes place with high pressure water. With the aid of high pressure water, particularly if it strikes the surfaces to be cleaned under an oblique angle, it is possible not only to remove firmly adhering contaminants, but also coarse matter and heavier objects from the lavatory pan or to float same away in the direction of the drain via the sloping floor. A completely satisfactory cleaning of the insides and outsides of the lavatory pan and the floor of the sanitary room, as well as optionally the lower part of the side walls can be ensured by a corresponding number, arrangement and orientation of the spray nozzles. There is no need for mechanically operating brushes which, particularly over long periods, become dirty and in certain circumstances reintroduce into the sanitary room dirt which has already been removed In the sense of such a complete cleaning, according to a preferred construction, the support arm has at least one spray nozzle directed onto the outer wall of the lavatory pan. It is also advantageous if the support arm has two or more spray nozzles, whose jet cone at least partly is directed onto the lower region of the sanitary room side walls. It is also advantageous if the support arm has a spray nozzle directed onto the floor of the technical room in the direction of the drain, so that any coarse matter left behind in the technical room can also be passed into the drain.

In further preferred manner the spray nozzles are oriented in such a way that the water striking the surface to be cleaned assists the removal of the dirty water and contaminants to the drain. This construction not only removes the dirty water, but also coarse matter and larger objects are floated into the technical room and drain.

In order to effectively cover all areas to be cleaned and assist the floating away of coarse objects, at least part of the spray nozzles and in particular those directed onto the sanitary room floor are angularly adjustable during the cleaning phase. Thus, for example, the spray nozzles directed onto the sanitary room floor are angularly adjustable towards the drain. The jet cone of the spray nozzle is virtually guided in an arc over the floor, so that not only strongly adhering dirt, but also coarse parts are effectively floated away.

The aforementioned construction can be realized in that the angularly adjustable nozzles are located on one or more supports, which are articulated by means of a guide rod to the support arm. The drive can be constituted by hydraulic cylinder e.g. arranged on the support arm and acting on the guide rod.

According to another preferred embodiment, the support arm has over at least part of its length a downwardly open dome or hood, below which are arranged the spray nozzles directed from above onto the lavatory pan and which extends to close to the contour of said pan.

This measure ensures that the cleaning water deflected in part in uncontrolled manner and striking the irregular contour of the lavatory pan under high pressure is not splashed in the sanitary room, particularly in the upwards direction, so that dirt particles and the like can also be removed. In the case of regular surfaces, such as e.g. the floor, there is no uncontrolled splashing risk, so that there is no need to provide a dome there.

In the case of the sanitary cubicle in EP-A1 No. 0 059 134 and forming the starting point for the present invention, there is a floor drain pipe in the sanitary room connected to the drain in the technical room. In the known construction it is constantly open and is located in the area below the lavatory pan. To the floor drain pipe is connected a duct bent at right angles and which issues into the drain. This construction is disadvantageous, because it is not possible to avoid odors via the open drain pipe and the nature of the guidance thereof gives rise to clogging. According to the invention it is possible to seal the floor drain pipe by a flap, which can be moved into the open position by the support arm for cleaning purposes. The flap provides an odor seal and also the floor drain pipe can issue directly into the drain. The flap is automatically controlled upwards for cleaning, in that it is e.g. movable by means of a control element on the support arm and during this movement can be moved into the open position into the sanitary room. Thus, no separate drive and control means are required, so that an operationally more reliable construction is obtained. The flap can be closed by the return movement of the support arm, but preferably under gravity.

In the known sanitary cubicle, there is a lavatory pan, whose base is not inclined rearwards and whose rear wall can be moved away in the cleaning phase, in order to free a large-surface drain pipe in the direction of the drain. According to the invention the rear wall of the lavatory pan can be moved from the use into the cleaning position by means of the movement of the support arm for the cleaning phase The rearward opening of the pan also takes place by the movement of the cleaning implement, so that there is no need for separate drive and control means, which could in turn give rise to operational problems.

An advantageous construction is realized in that the rear wall of the lavatory pan is pivotably mounted to its base in the vicinity of the rear drain edge and can be moved out of the upwardly directed use position into a downwardly inclined cleaning position towards the drain in the technical room.

This makes it possible to spray and clean in problem-free manner the lavatory pan rear wall, particularly if its rearward gradient is the same as that of the bottom of the lavatory pan. It is optionally possible to provide a coarse rake below the drain edge of the rearwardly inclined rear wall and above the drain in order to hold back coarse matter, which is removed every so often from the technical room.

According to a preferred embodiment the flap for the bottom drain pipe and the rear wall of the lavatory pan are movable into the opening or cleaning position by means of a single control element on the support arm.

This construction leads to a particularly simple forced control of the flap for the bottom drain pipe and the rear wall of the lavatory pan in conjunction with the movement of the cleaning element, with this forced coupling taking place in a purely mechanical and therefore robust and operationally reliable manner.

Appropriately the support arm is pivotable by means of a drive from an approximately upright position in the technical room into a horizontal position in the sanitary room, where its free end extends into the vicinity of the door. The drive is preferably constituted by a hydraulic motor.

Finally, according to a preferred embodiment, the walls of the sanitary room are formed by a substantially cylindrical cabin, mounted in rotary manner on a vertical shaft in the sanitary room having an access opening for the sanitary cubicle door and which is so rotatable for the cleaning phase that the passage opening is directed towards the technical room.

In conjunction with the inventive construction of the cleaning implement, a construction such as described in DE-C2-No. 30 22 778 has the advantage that there is a large-area passage opening for the support arm with the spray nozzles, so that in particular there can be a plurality of spray nozzle at right angles to the support arm pivot plane.

BRIEF DESCRIPTION OF THE DRAWING

The invention is described in greater detail hereinafter relative to a non-limitative embodiment and the attached drawings, wherein.

DETAILED DESCRIPTION

Figure 1:
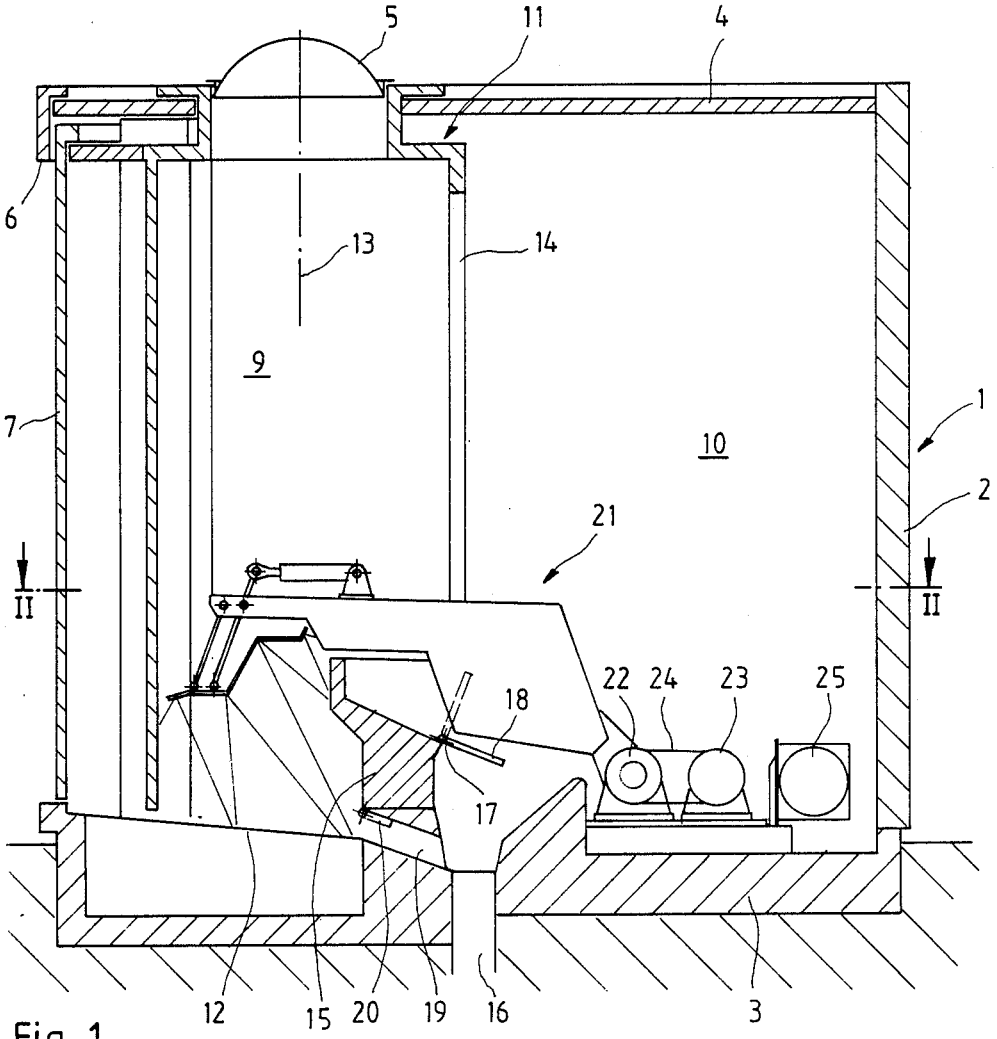
FIG. 1 is a vertical cross-sectional schematic view of a sanitary cubical constructed in accordance with the present invention during a cleaning phase.
Figure 2:
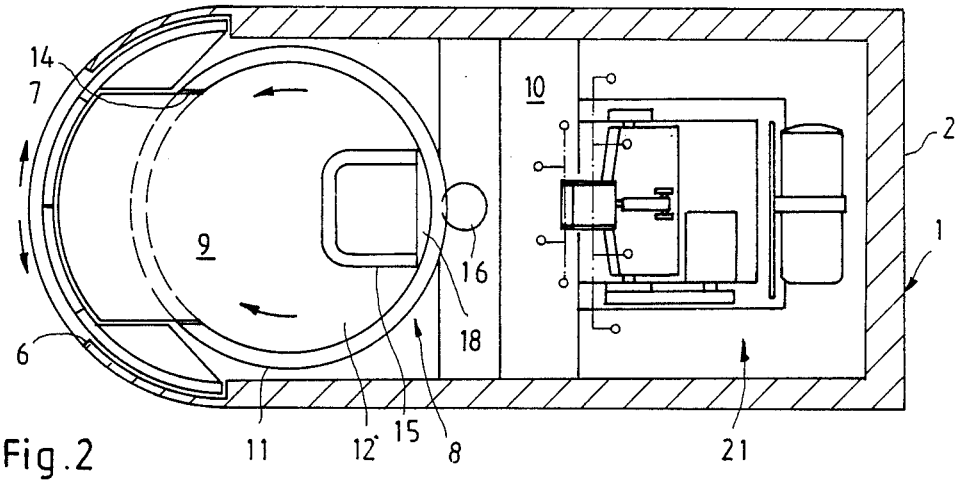
FIG. 2 is a cross-sectional view taken along the line II—II in FIG. 1 after the cleaning phase.

The sanitary cubicle generally designated by the reference numeral 1 shown in FIGS. 1 and 2 comprises a three-dimensional cubicle or cell 2, of, for example, reinforced concrete, a trough 3, optionally also of reinforced concrete, a ceiling 4 with a skylight 5. On one narrow side the cubicle 2 has an access opening 6, which can be closed by a sliding door 7 mounted in the interior of the cubicle and which can, for example, be opened by inserting a coin.

The sanitary cubicle 1 has a sanitary room 9 and a technical room 10, which FIG. 2 are subdivided by a partition generally designated by the reference numeral 8 (FIG. 2). The partition 8 form part of a cabin 11, which is terminated at the bottom by a fixed floor 12 and is inserted in rotary manner about a shaft 13 in the three-dimensional cell 2. Cabin 11 has a door-like opening 14, which in the use position is roughly aligned with the access opening 6 (FIG. 2) and for the cleaning phase can be brought into the position shown in FIG. 1 by rotating cabin 11 and in which it forms an access opening for the technical room 10

A lavatory pan or water closet 15 is installed in fixed manner on trough 3 and within the sanitary room 9 and its inner face or base is inclined towards a drain 16 in the technical room 10. In the vicinity of the rear drain edge 17 of the base, the lavatory pan 15 has a pivotably mounted rear wall 18, which can be pivoted from a roughly vertical position, where it seals off to the rear the pan at the time of use, into a position inclined rearwards towards the drain 16 during the cleaning phase.

The fixed floor 12 is inclined towards the drain 16 in technical room 10 and has a drain pipe 19, which issues into drain 16. During the use period, drain pipe 19 is closed by a flap 20 and can be pivoted into the position shown in Fig. 1 during the cleaning phase.

The sanitary cubicle 1 has a cleaning implement generally designated by the reference numeral 21, which is normally housed in the technical room 10 (FIG. 2) and, for the cleaning phase, can be moved through opening 14 into the cabin 11 or sanitary room 9. For this purpose the cleaning implement 21 is pivotably mounted at 22 in technical room 10 and by a drive 23 such as, for example, a hydraulic motor and by an endless drive 24 can be pivoted from a roughly vertical position in technical room 10 into a roughly horizontal position in sanitary room 9 during the cleaning phase. Hydraulic motor 23 is supplied by a hydraulic unit 25 located in the technical room 10.

Figure 3:
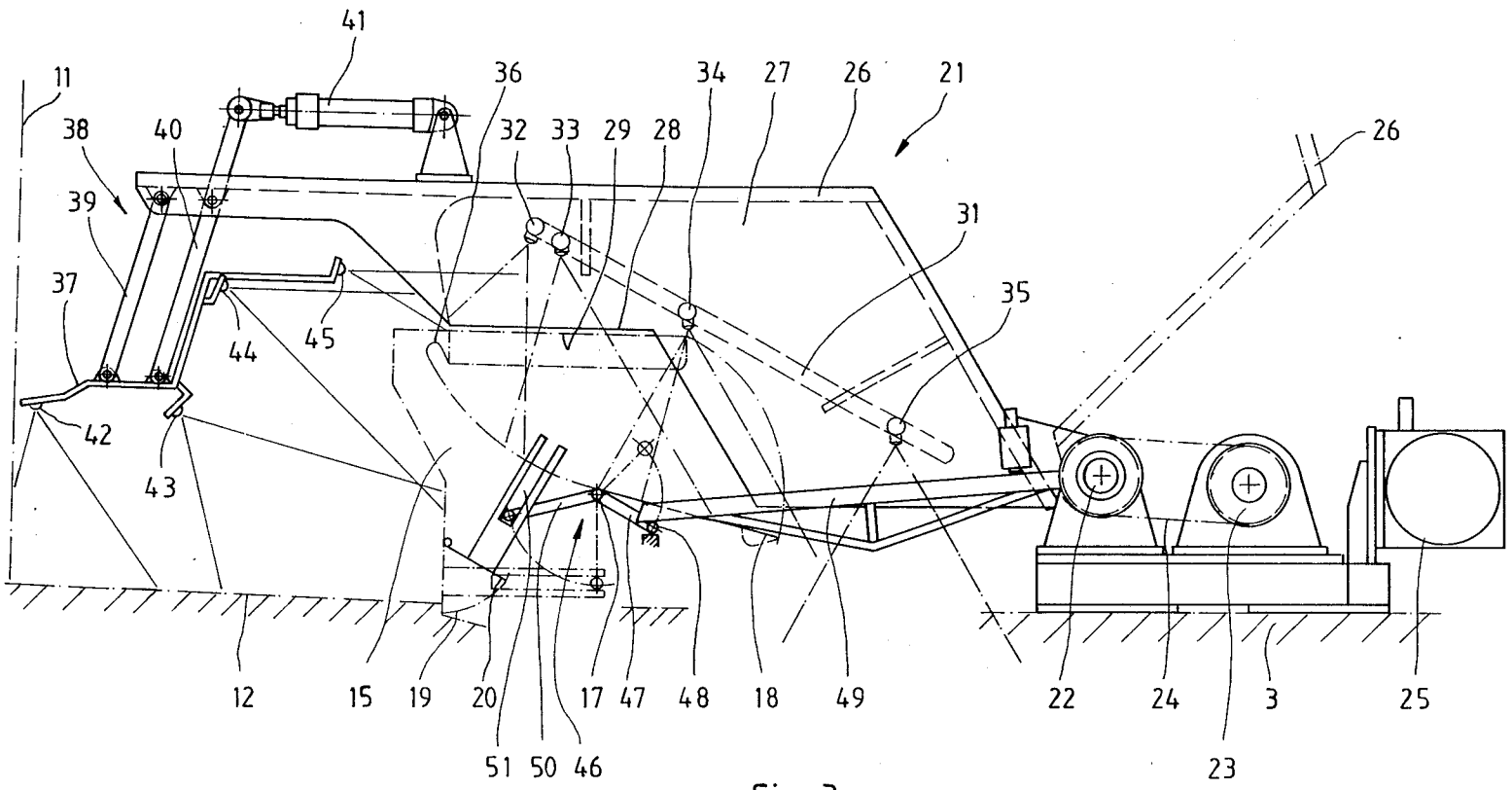
FIG. 3 is a schematic view, on an enlarged scale, of a cleaning implement constructed in accordance with the present invention during a cleaning phase.
Figure 4:
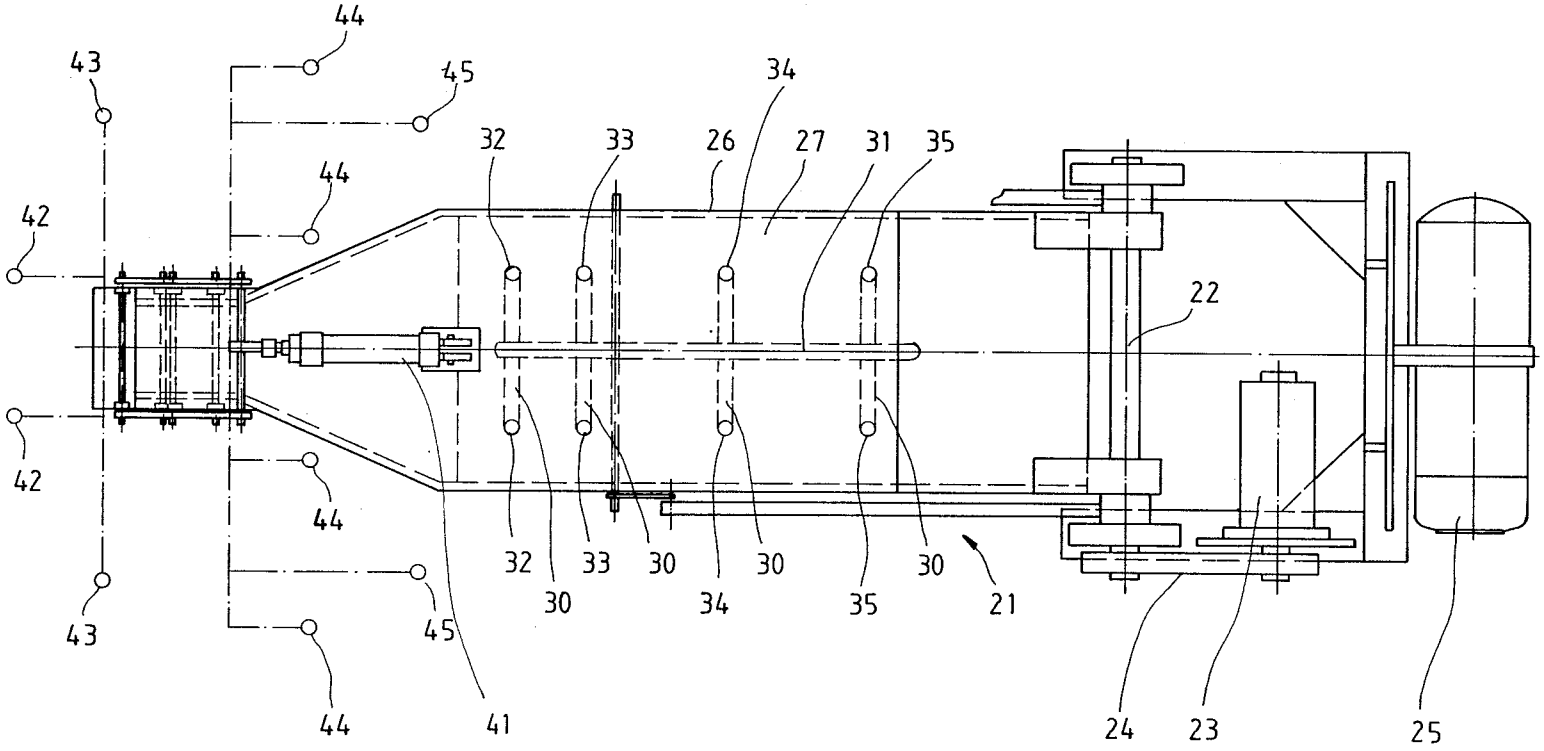
FIG. 4 is a plan view of the cleaning implement of Fig. 3.

Cleaning implement 21 is shown in greater detail in FIGS. 3 and 4. It has a support aim 26 in the form of an angle bracket, which extends approximately up to the wall of cabin 11 facing opening 14 during the cleaning phase. It passes over the lavatory pan 15 and, in this area, is constructed as a dome 27, whose lower edge 28 terminates roughly with the upper edge 29 of pan 15, whilst it projects freely forwards over said pan.

Outside dome 27 are provided on transversely directed pipes 30, which are connected to a common main 31, pairwise cleaning nozzles 32, 33, 34, 35, whereof the cleaning nozzles 32, 33 are directed into the interior of the lavatory pan 15, cleaning nozzles 34 onto the rearwardly flapped rear wall of the pan 15 and cleaning nozzles 35 into the drain 16 in technical room 10. The lavatory pan 15 can obviously have a flushing edge 36 in the usual way by which water is fed into the lavatory pan 15 during the first flushing stage.

In the area projecting forwards over the lavatory pan 15, the support arm has further cleaning nozzles, which are arranged on a common support 37 and are angularly adjustable by means of the latter. For this purpose support 37 is fitted to a parallelogram linkage means generally designated by the reference numeral 38 with two arms 39, 40, whereof one arm 40 acts as a linkage and is operated by a hydraulic cylinder 41 on the support arm 26. The support carries at least pairwise cleaning nozzles 42, 43, which are directed onto the sloping bottom 12 and side walls of the cabin 11, as well as cleaning nozzles 44, 45 directed onto the outside of the lavatory pan 15. By adjusting the support 37, it is possible to move the cleaning nozzles 42, 43 from front to rear in the direction of the drain pipe 19, whilst the cleaning nozzles 44, 45 splash or spray the pan under varying angles. All the cleaning nozzles 32 to 35 and 42 to 45 are connected to a high pressure water source, e.g. to the public water main.

In the illustrated embodiment, on the pivot bearing 17 of rear wall 18 of lavatory pan 15 is located an angle lever 46, on whose one arm 47 acts by a step 48 a control element 49 on support aim 26, while the other arm 50 engages in a link 51, to which is fitted the flap 20 for the bottom drain pipe 19. In the use position (shown in broken line manner in FIG. 3), i.e. with the rear wall 18 virtually perpendicular, arm 47 projects upwards. If the cleaning implement 21 is pivoted into cabin 11, then the control element 49 presses the arm 47 and therefore rear wall 18 downwards, while the downwardly projecting arm 50 is raised and the link 51 pivoted upwards, so that the flap 20, which closes under gravity, is pivoted into the open position. on pivoting back the cleaning implement into the technical room, the rear wall 18 and flap 20 move in the opposite direction.

I claim:

1. Public sanitary cubicle comprising a sanitary room, a drain means provided in the sanitary room, a floor means provided in the sanitary room and inclined towards said drain means, a water closet disposed in the sanitary room, door means for providing access to the sanitary room, a technical room subdivided by a partition means and being adapted to accommodate means for supplying, disposal and cleaning of the sanitary room including cleaning means adapted to be brought up to the water closet by a support arm means after moving at least a portion of the partition means, a plurality of spray nozzle means disposed on said support arm means and connected to a pressure water source, wherein at least two of said plurality of spray nozzle means are directed from above in different angular positions onto the water closet, and at least two other spray nozzle means of said plurality of spray nozzle means are directed at least onto the floor means of the sanitary room.

2. Sanitary cubicle according to claim 1, wherein at least one spray nozzle means of the at least two spray nozzle means directed onto the water closet is directed onto a outer wall of the water closet.

3. Sanitary cubicle according to one of claims 1 or 2, wherein at least one of the at least two other spray nozzle means includes a jet cone directed at least partly onto a lower region of sidewalls of the sanitary room.

4. Sanitary cubicle according to claim 3, wherein the support arm means has at least one additional spray nozzle means directed onto a floor of the technical room in a direction of the drain means.

5. Sanitary cubicle according to claim 4, wherein all of the spray nozzle means are oriented so that the water supplied by the respective spray nozzle means strikes a surface to be cleaned to assist in a removal of dirty water and contaminants toward the drain means.

6. Sanitary cubicle according to claim 5, wherein some of the spray nozzle means are provided for angularly adjusting at least means during a cleaning phase.

7. Sanitary cubicle according to claim 6, wherein the spray nozzle means adjustable by said means for angularly adjusting are adjustable in the direction of the drain means.

8. Sanitary cubicle according to claim 7, wherein said support arm means includes at least one support member for supporting at least some of the spray nozzle means adjustable by said means for angularly adjusting, and wherein said means for angularly adjusting includes a driven guiding linkage means for articulatingly connecting the at least one support member on the support arm means.

9. Sanitary cubicle according to claim 7, wherein a downwardly open shroud means is provided over at least a portion of a length of the support arm means close to a contour of the water closet, and wherein at least the spray nozzle means directed from above onto the water closet are disposed below the shroud means.

10. Sanitary cubicle according to claim 9, further comprising a bottom drain pipe means arranged in the sanitary room and connected to the drain means therein and to a further drain means in the technical room, and flap means disposed in said drain pipe means for closing the same, said flap means being adapted to be moved into an open position by said support arm means for the cleaning phase.

11. Sanitary cubicle according to claim 10, wherein a control means is provided on the support arm means for moving the flap means into an open position during the movement of the support arm means into the sanitary room.

12. Sanitary cubicle according to claim 11, wherein the flap means closes under gravity.

13. Sanitary cubicle according to claim 12, wherein the water closet includes a rearwardly inclined base means, and rear wall means adapted to be moved away in the cleaning phase in order to free a large-surface discharge in the direction towards the drain means, and wherein the rear wall means is moved from a use position into a cleaning position by movement of the support arm means.

14. Sanitary cubicle according to claim 13, wherein the rear wall means is pivotally mounted on the base means thereof in a vicinity of a rear discharge edge of the water closet and is movable out of an upwardly directed use position into a cleaning position inclined towards the further drain means in the technical room.

15. Sanitary cubicle according to claim 14, wherein the control means includes a single control element on the support arm means connected to the flap means and the rear wall means so as to move the same into an open or cleaning position.

16. Sanitary cubicle according to claim 15, further comprising a drive means for pivotably moving said support arm means from an approximately vertical position in the technical room into a horizontal position in the sanitary room with a free end of the support arm means extending into a vicinity of the door means.

17. Sanitary cubicle according to claim 16, wherein the sanitary room is formed as a substantially cylindrical cabin mounted for rotary movement about a vertical shaft in the sanitary cubicle, and wherein a passage means opens toward the door means during use of the sanitary cubicle, said passage means opening toward the technical room upon rotation of the cylindrical cabin to permit the cleaning phase.

18. Sanitary cubicle according to claim 6, wherein the spray nozzle means directed onto the floor means of the sanitary room are adjustable by said means for angularly adjusting.

19. Sanitary cubicle according to claim 18, wherein the spray nozzle means directed onto the floor means of the sanitary room are adjustable in a direction of the drain means by said means for angularly adjusting.

20. Public sanitary cubicle according to claim 1, wherein the support arm means has at least one additional spray nozzle means directed onto a floor of the technical room in a direction of the drain means.

21. Sanitary cubicle according to claim 1, wherein all of the spray nozzle means are oriented so that the water supplied by the respective spray nozzle means strikes a surface to be cleaned to assist in a removal of dirty water and contaminants toward the drain means.

22. Sanitary cubicle according to claim 1, wherein means are provided for angularly adjusting at least some of the spray nozzle means during a cleaning phase.

23. Sanitary cubicle according to claim 7, wherein the spray nozzle means angularly adjustable by said means for angularly adjusting are adjustable in a direction of the drain means.

24. Sanitary cubicle according to claim 1, wherein said support means includes at least one support member for supporting at least some of said spray nozzle means, and wherein a driven guiding linkage means is provided for articulatingly connecting the at least one support member on said support arm means.

25. Sanitary cubicle according to claim 1, wherein a downwardly open shroud means is provided over at least a portion of a length of the support arm means close to a contour of the water closet, and wherein at least the spray nozzle means directed from above onto the water closet are disposed below the shroud means.

26. Sanitary cubicle according to claim 1, further comprising a bottom drain pipe means arranged in the sanitary room and connected to the drain means therein and to a further drain means in the technical room, flap means are disposed in said drain pipe means for closing the same, said flap means being adapted to be moved into an open position by said support arm means for the cleaning phase.

27. Sanitary cubicle according to claim 26, wherein a control means is provided for moving the flap means into an open position during a movement of the support arm means into the sanitary room.

28. Sanitary cubicle according to claim 27, wherein the flap means closes under gravity.

29. Sanitary cubicle according to claim 1, wherein the water closet includes a rearwardly inclined base means, and rear wall means adapted to be moved in the cleaning phase in order to free a large-surface discharge in a direction toward the drain means, and wherein the rear wall means is moved from a use position into a cleaning position by movement of the support arm means.

30. Sanitary cubicle according to claim 29, wherein the rear wall means is pivotably mounted on the base means in a vicinity of a rear discharge edge of the water closet and is movable out of an upwardly directed use position into a position inclined downwardly toward a drain means in the technical room.

31. Sanitary cubicle according to claim 30, further comprising a single control means on the support arm means connected to the flap means and the rear wall means so as to move the same into an open or cleaning position.

32. Sanitary cubicle according to claim 1, further comprising drive means for pivotably moving said support arm means from an approximately vertical position in the technical room into a horizontal position in the sanitary room with a free end of the support arm means extending into a vicinity of the door means.

33. Sanitary cubicle according to claim 1, wherein the sanitary room is formed as a substantially cylindrical cabin mounted for rotary movement about a vertical shaft in the sanitary cubicle, and wherein a passage means open toward the door means during use of the sanitary cubicle, said passage means opening toward the technical room upon rotation of the cylindrical cabin to permit the cleaning phase.

* * * * *